US007090623B2

(12) United States Patent
Stewart et al.

(10) Patent No.: US 7,090,623 B2
(45) Date of Patent: Aug. 15, 2006

(54) PRESS STATION WITH ADJUSTABLE, VARIOUS PATH FEATURE

(75) Inventors: Jonathan M. Stewart, Seattle, WA (US); Philip S. Lamb, Seattle, WA (US); Peter J. Arnold, Snohomish, WA (US)

(73) Assignee: Precor Incorporated, Woodinville, WA (US)

( * ) Notice: Subject to any disclaimer, the term of this patent is extended or adjusted under 35 U.S.C. 154(b) by 485 days.

(21) Appl. No.: 10/465,126

(22) Filed: Jun. 18, 2003

(65) Prior Publication Data

US 2004/0259700 A1 Dec. 23, 2004

(51) Int. Cl.
*A63B 21/078* (2006.01)
*A63B 21/062* (2006.01)

(52) U.S. Cl. ..... 482/100; 482/137; 482/138; 482/139; 482/908

(58) Field of Classification Search ..... 482/97, 482/100, 133–138, 908
See application file for complete search history.

(56) References Cited

U.S. PATENT DOCUMENTS

| | | | | | |
|---|---|---|---|---|---|
| 4,773,398 | A | | 9/1988 | Tatom | |
| 4,949,951 | A | | 8/1990 | Deola | |
| 5,120,289 | A | * | 6/1992 | Yu | 482/137 |
| 5,273,504 | A | | 12/1993 | Jones | |
| 5,342,270 | A | * | 8/1994 | Jones | 482/98 |
| 5,362,290 | A | * | 11/1994 | Huang | 482/100 |
| D359,326 | S | | 6/1995 | Deola | |
| 5,437,589 | A | | 8/1995 | Habing | |
| 5,456,644 | A | * | 10/1995 | Hecox et al. | 482/127 |
| 5,580,341 | A | | 12/1996 | Simonson | |
| 5,605,524 | A | * | 2/1997 | Husted | 482/112 |
| 5,643,152 | A | | 7/1997 | Simonson | |
| 5,665,036 | A | | 9/1997 | Hsieh | |
| 5,667,464 | A | | 9/1997 | Simonson | |
| 5,769,757 | A | | 6/1998 | Fulks | |
| 5,788,614 | A | | 8/1998 | Simonson | |
| 5,810,701 | A | | 9/1998 | Ellis et al. | |
| 5,833,585 | A | | 11/1998 | Jones et al. | |
| 5,967,954 | A | * | 10/1999 | Habing | 482/137 |
| 6,004,247 | A | * | 12/1999 | Webber | 482/100 |
| 6,030,322 | A | | 2/2000 | Webber | |
| 6,080,091 | A | | 6/2000 | Habing et al. | |
| 6,152,864 | A | | 11/2000 | Giannelli et al. | |
| 6,234,941 | B1 | | 5/2001 | Chu | |
| 6,302,833 | B1 | | 10/2001 | Ellis et al. | |

(Continued)

FOREIGN PATENT DOCUMENTS

GB 2 162 433 A 2/1986

*Primary Examiner*—Jerome Donnelly
*Assistant Examiner*—Victor K. Hwang
(74) *Attorney, Agent, or Firm*—Terence P. O'Brien; Christensen O'Conner Johnson Kindness

(57) ABSTRACT

An exercise apparatus (100) for performing press exercises is disclosed. The exercise apparatus includes a frame (102) and a support assembly (118) adjustably coupled to the frame. A first press arm (108) is coupled to the support assembly and is pivotal about a first pivot axis (140A) between a rest position and an extended position. An adjustment mechanism (152) is coupled to the support assembly and adapted to selectively adjust the support assembly between a first position, wherein when the first press arm is rotated about the first pivot axis a preselected angle, a distal end (304A) of the first press arm scribes a first predetermined path (300A), and a second position, wherein when the first press arm is rotated about the first pivot axis the preselected angle, the distal end scribes a second predetermined path (302A).

52 Claims, 9 Drawing Sheets

U.S. PATENT DOCUMENTS

| | | | | |
|---|---|---|---|---|
| 6,394,937 | B1 * | 5/2002 | Voris | 482/139 |
| 6,471,624 | B1 * | 10/2002 | Voris | 482/142 |
| 6,508,748 | B1 * | 1/2003 | Ish, III | 482/100 |
| 6,860,840 | B1 * | 3/2005 | Carter | 482/97 |
| 2002/0107117 | A1 | 8/2002 | Carter | |
| 2003/0064868 | A1 | 4/2003 | Ish, III et al. | |
| 2004/0029687 | A1 * | 2/2004 | Hogg | 482/142 |
| 2004/0147376 | A1 * | 7/2004 | Gautier | 482/93 |
| 2004/0162195 | A1 * | 8/2004 | Habing | 482/100 |
| 2005/0054495 | A1 * | 3/2005 | Stewart et al. | 482/100 |
| 2006/0128535 | * | 6/2006 | Smith | 482/94 |

* cited by examiner

PRESS STATION WITH ADJUSTABLE, VARIOUS PATH FEATURE

FIELD OF THE INVENTION

The present invention relates generally to the field of exercise and physical rehabilitation equipment, and more particularly, to exercise apparatuses for exercising the muscles of an upper torso of a user.

BACKGROUND OF THE INVENTION

The benefits of muscle exercises directed at the upper torso of a user are well known. For example, press exercises directed at the strengthening of the muscles of the upper torso after injury or surgery are well known in their ability to strengthen the muscles, to prevent atrophy of the muscles and return the muscles to normal operation. Further, press exercises are well known for their ability to increase performance, strength, and/or enhance the appearance of one's body. Various press exercises have been developed to exercise the muscles of the upper torso, most of which involve contracting and/or extending one's arms against a resistant force, the resistant force provided by an exercise apparatus.

Although previously developed press exercise apparatuses are effective, they are not without their problems. In a typical embodiment of previously developed press exercise apparatuses, a pair of press arms is coupled to a resistance source, such as a stack of weights. In operation, the user grasps a handle of each press arm and presses the handles outward from the chest of the user to exercise the muscles of the upper torso. Inasmuch as the press arms are restricted to paths extending perpendicularly outward from the chest, the press exercise apparatus fails to permit the user's hands to move inward toward one another during the exercise, in a more natural motion.

A few of the previously developed press exercise apparatuses have addressed this limitation by permitting inward movement of the press arms along a single selected, predetermined path. However, these press exercise apparatuses are not without their drawbacks. For instance, although the press exercise apparatuses allow inward movement, they do not allow the user to configure the press exercise apparatus such that press arms will follow a specific predetermined path selected from a multitude of different predetermined paths. Thus, the user is unable to choose a specific predetermined path that provides optimum comfort, a desired focus of the exercise upon a specific muscle or portion of a muscle, or an optimum orientation of the predetermined path relative to the specific body size of the user.

Previously developed press exercise apparatuses often permit a user to adjust a position of a seat in relation to a rest position of the press arms. Further, previously developed press exercise apparatuses permit the adjustment of the positions of the rest position of the press arms. In some of these devices, though, a user must separately adjust the position of the seat and the rest position of the press arms, resulting in an iterative adjustment process. More specifically, when a user adjusts the position of the seat, the user's orientation relative to the rest position of the press arms is changed, thereby necessitating the user to readjust the rest position of the press arms. Once the rest position of the press arms is changed, the readjustment of the seat position may be necessary. Thus, such adjustment can be an iterative process that can be awkward, time consuming, and frustrating for a user.

Previously developed exercise apparatuses often utilize adjustment mechanisms for adjusting a separation distance between a first part of the apparatus and a second part of the apparatus, to adjust some aspect of the operation of the press exercise apparatus. Previously developed adjustment mechanisms, while permitting a separation distance between a first part and a second part to be varied, permit the distance to be varied even when the adjustment mechanism is under a load. Thus, when a user manipulates the adjustment mechanism to alter the separation distance, the load can be suddenly and undesirably released.

SUMMARY OF THE INVENTION

An exercise apparatus for performing press exercises is disclosed. The exercise apparatus includes a frame and a support assembly adjustably coupled to the frame. A first press arm is pivotally coupled to the support assembly to pivot about a first pivot axis between a rest position and an extended position. An adjustment mechanism is coupled to the support assembly and adapted to selectively adjust an orientation of the support assembly relative to the frame between a first position, wherein, when the first press arm is rotated about the first pivot axis a preselected angle, a distal end of the first press arm scribes a first predetermined path, and a second position, wherein, when the first press arm is rotated about the first pivot axis the preselected angle, the distal end scribes a second predetermined path.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
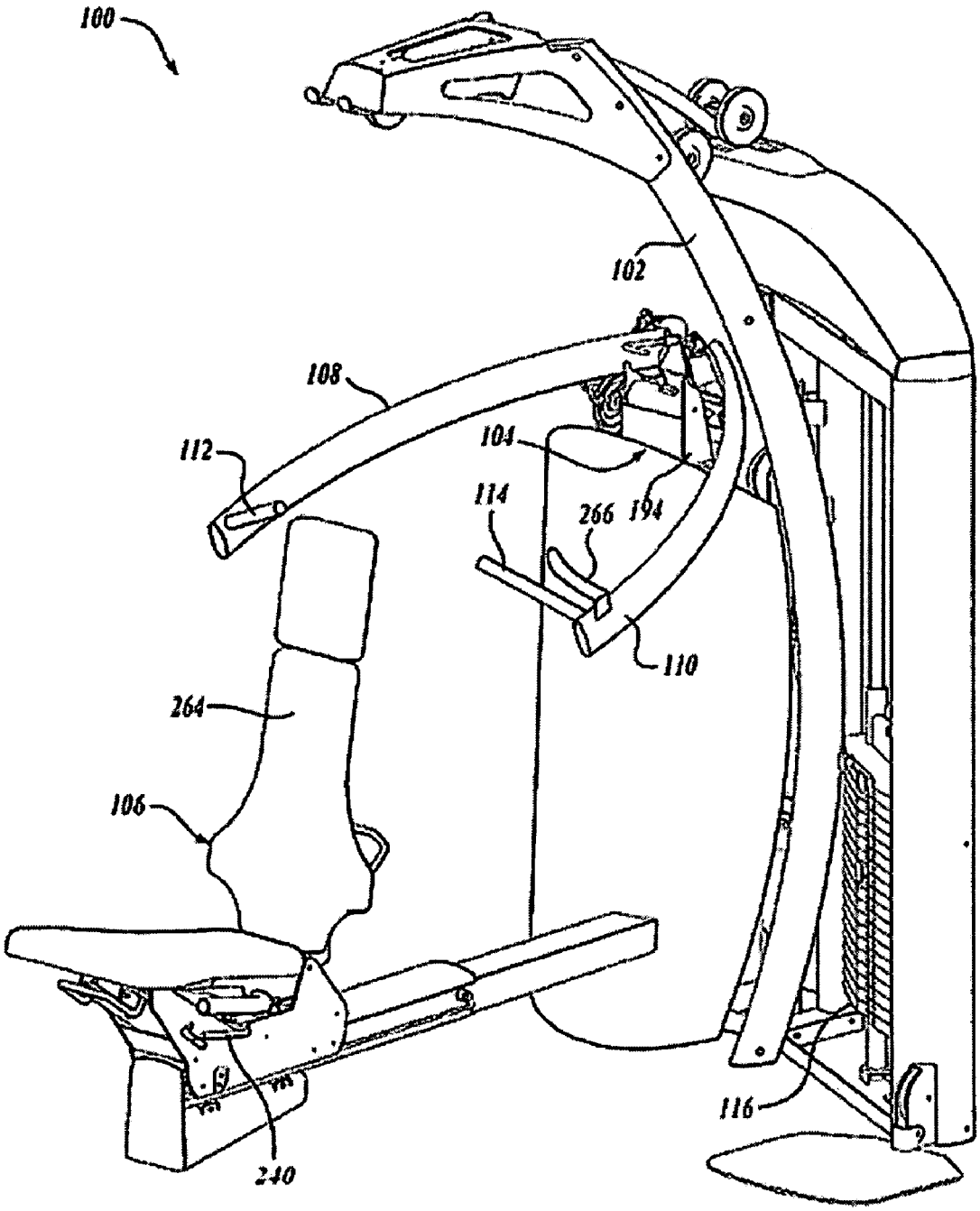
FIG. 1 is a perspective view of one embodiment of an exercise apparatus formed in accordance with present invention.

FIGS. 1–9 illustrate one embodiment of an exercise apparatus 100 formed in accordance with the present invention. Referring to FIG. 1, the exercise apparatus 100 is adjustable to provide a plurality of exercises for strengthening and toning muscles of a user. The exercise apparatus 100 includes a frame 102 with a press assembly 104 and a seat 106 mounted thereto. The press assembly 104 includes a first press arm 108 and a second press arm 110, both pivotally coupled to the frame 102.

The press arms 108 and 110 each include a handle 112 and 114. A user may grasp the handles 112 and 114 while sitting in the seat 106 and press upwardly and/or outward on the handles 112 and 114, thereby rotating the press arms 108 and 110 relative to the frame 102. A resistance source 116, such as a stack of weights, is coupled to the press arms 108 and 110 to provide resistance to the user's rotation of the press arms 108 and 110. Although a specific resistance source 116 is shown in the illustrated embodiment, it should be apparent to those skilled in the art that alternate resistance sources, such as resistance sources based on electricity, friction, air movement, elastic forces, spring forces, magnets, or other resistance sources known in the art are suitable for use with and within the scope of the present invention.

The seat 106 and press assembly 104 are adjustable to allow the user to perform a variety of exercises, especially for strengthening the upper torso. For instance, the user may adjust the seat 106 and the press assembly 104 to perform a decline press, bench press, incline press, military press, shoulder press, or other exercises known in the art. Further, the press assembly 104 is adjustable to allow the user to alter the rest position of the press arms 104 and 106, which in the illustrated embodiment involves adjusting the resting height of the handles 112 and 114 relative to the floor, seat, or frame. For instance, the user may adjust the press arms 108 and 110 from the rest position shown in FIG. 8 to the rest position shown in FIG. 9. Further, the press assembly 104 is adjustable to allow the user to alter the predetermined path that the arms handles 112 and 114 will scribe when rotated, such as between predetermined paths 300A and 300B and predetermined paths 302A and 302B depicted in FIG. 6.

Figure 2:
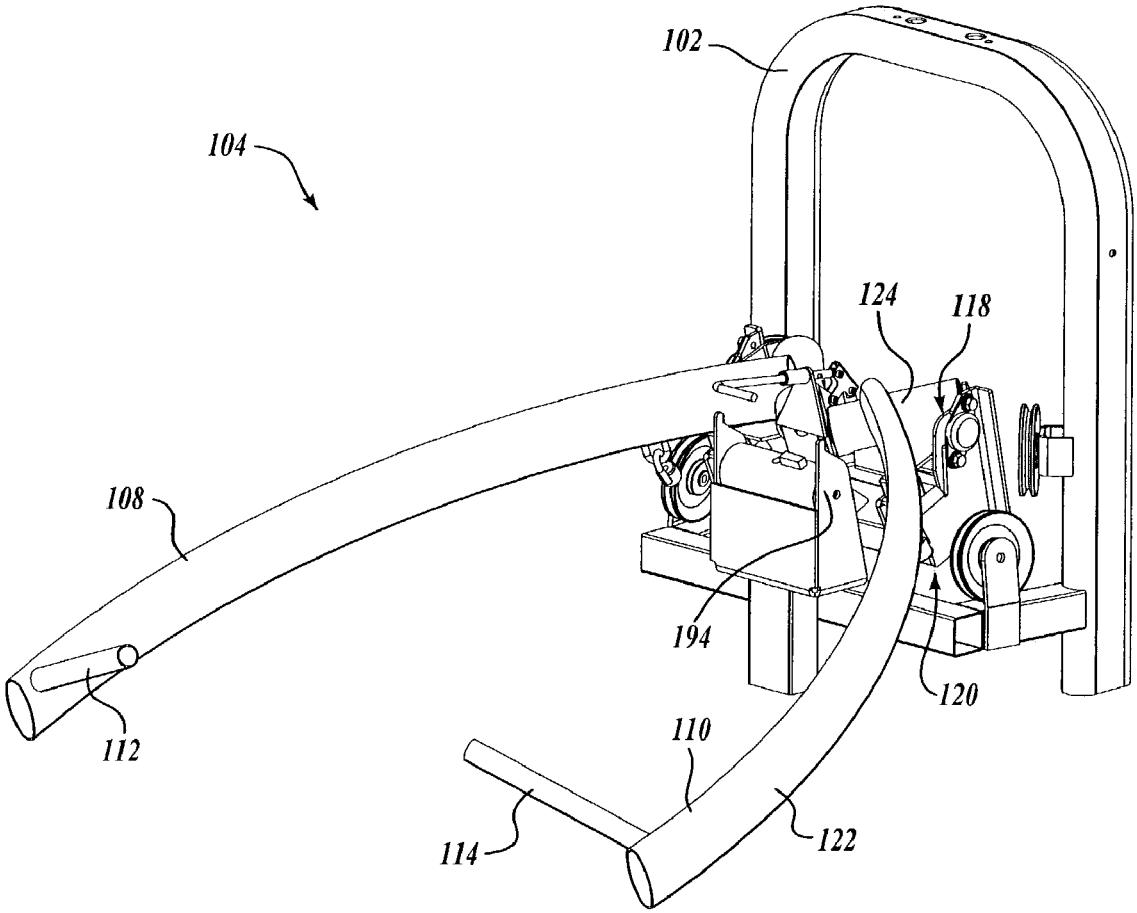
FIG. 2 is a perspective view of aspects of the press assembly depicted in FIG. 1.
Figure 3:
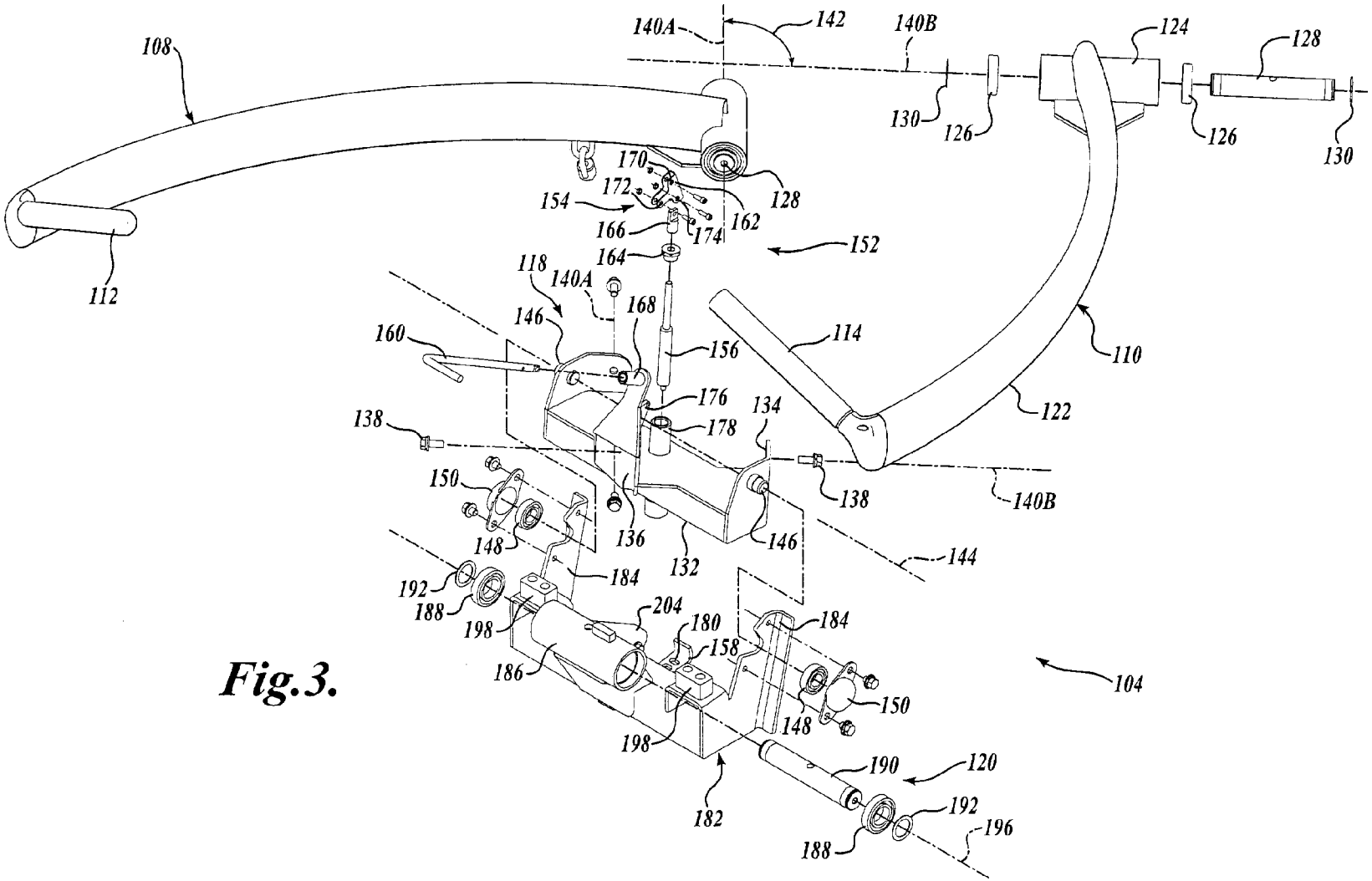
FIG. 3 is an exploded perspective view of the press assembly depicted in FIG. 1.

In more detail and referring to FIGS. 2 and 3, the press assembly 104 includes first and second press arms 108, 110, a support assembly 118, and a rest position assembly 120. In this embodiment, the second press arm 110 is a curved, tubular strut 122 extending between a bearing tube 124. The bearing tube 124 is designed to house a pair of press arm pivot bearings 126 which rotatingly receive a press arm pivot axle 128 therebetween. Retaining rings 130 are placed on the outward facing sides of each press arm pivot bearing 126 to retain the bearing in place. The first press arm 108 is substantially similar in construction to the second press arm 110, therefore, the description above of the second press arm 110 shall be understood as also referring to the first press arm 108.

The press arms 108 and 110 are pivotally coupled to the support assembly 118. More specifically, the press arms 108 and 110 are pivotally coupled to a weldment 132 that forms part of the support assembly 118. The press arms 108 and 110 are coupled to the weldment 132 by fastening the press arm pivot axles 128 to spaced-apart, opposing mounting brackets 134 and 136 with screw fasteners 138. The press arm pivot axles 128 each define a press arm pivot axis 140A and 140B.

In the illustrated embodiment, the pivot axes 140A and 140B are separated by a separation angle 142 from one another as measured in a plane containing both pivot axes 140A and 140B. In the illustrated embodiment, the separation angle is about 90 degrees. Although the pivot axes 140A and 140B are described in the illustrated embodiment as having a specific separation angle 142, it should be apparent to those skilled in the art that other separation angles 142, such as for example separation angles in the range of about 80 degrees to about 100 degrees, are suitable for use with and within the scope of the present invention.

The separation angle 142 controls the amount of inward and outward motion that will be experienced by the distal ends of the press arms as they follow their predetermined paths. In the embodiment shown, the separation angle 142 is a fixed amount, however, it will be readily appreciated that a configuration may be made in which the angle 142 is adjustable. Increasing the separation angle 142 has the effect of bringing their respective axes toward a more parallel relationship, which effectively decreases the overall lateral distance experienced by the arm ends during use. Decreasing the separation angle 142 has the opposite effect.

In general, the support assembly uses a pin to engage one of a series of adjustment holes, or apertures, in order to orient the support assembly with respect to the rest position assembly. More specifically, the support assembly 118 is pivotally coupled to the rest position assembly 120 about a pivot axis 144. The pivot axis 144 is defined by a pair of stub shafts 146 extending in opposite directions from the weldment 132. The stub shafts 146 are engaged by the rest position assembly 120 via a pair of bearings 148 adapted to rotatingly receive the stub shafts 146. Once the stub shafts 146 are received by the bearings 148, the support assembly 118 is able to rotate about the support assembly pivot axis 144. The bearings 148 are housed within a pair of bearing covers 150 retained in position by screw fasteners or other types of fasteners.

A support assembly adjustment mechanism 152 adjusts the inclination of the support assembly 118 relative to the rest position assembly 120. The support assembly adjustment mechanism 152 includes a linkage group 154, a locking pin 156, and an adjustment rack 158. The linkage group 154 includes a handle 160, a connecting link 162, a locking pin capture nut 164, and a locking pin 166, all of which are coupled to the weldment 132. The handle 160 passes through a first support tube 168 coupled to the support assembly 118 and connects to the connecting link 162 at a first mounting aperture 170. The connecting link 162 pivots about its second mounting aperture 172, which is pivotally coupled to a mounting bracket 176 coupled to the support assembly 118. A third mounting aperture 174 of the connecting link 162 is coupled to the locking pin 166, which is in turn coupled to the locking pin 156. The locking pin 156 passes through a second support tube 178 coupled to the support assembly 118. The distal end of the locking pin 156 selectively engages a plurality of apertures 180 in the adjustment rack 158, which is coupled to the rest position assembly 120.

In operation, the handle 160 is pulled, thereby pivoting the connecting link 162 about its second mounting aperture 172. As the connecting link 162 is pivoted, the locking pin 166 is pulled upward, thereby pulling the attached locking pin 156 upward such that the distal end of the locking pin 156 disengages from one of the apertures 180 in the adjustment rack 158. Once the locking pin 156 is disengaged from the adjustment rack 158, the support assembly 118 is free to rotate about the support assembly pivot axis 144. Once the support assembly 118 is rotated to a selected inclination relative to the rest position assembly 120, the handle 160 is released such that the distal end of the locking pin 156 engages one of the apertures 180 of the adjustment rack 158, thereby impeding further rotation of the support assembly 118 relative to the rest position assembly 120. Rotating the support assembly 118 permits a user to adjust the path the handles 112 and 114 will scribe when rotated from the rest to the extended positions, as will be discussed in greater detail below.

Focusing now on the structure of the rest position assembly 120, the rest position assembly 120 includes a press yoke 182. The press yoke 182 includes a pair of upwardly extending arms 184 upon which the previously described bearings 148 and bearing covers 150 are mounted to permit the pivotal attachment of the support assembly 118 relative to the rest position assembly 120. A bearing tube 186 is coupled to the press yoke 182. The bearing tube 186 is designed to house a pair of pivot bearings 188, which rotatingly receive a pivot axle 190 therebetween. Retaining rings 192 are placed on the outward facing side of each pivot bearing 188. The pivot axle 190 is coupled to a mounting bracket 194 (see FIG. 1) that is attached to the frame 102, thereby permitting the combination of the rest position assembly 120 and attached support assembly 18 to pivot about a rest position pivot axis 196. Of note, the support assembly pivot axis 144 is oriented substantially parallel with the rest position assembly pivot axis 196. Rotating the rest position assembly 120 permits a user to adjust the location of the rest position of the press arms 108 and 110, as will be discussed in greater detail below.

A pair of limit stops 198 are mounted on the press yoke 182. The limit stops 198 of the illustrated embodiment may be made from a resilient material, a few suitable examples being rubber and polyurethane. However, it should be apparent to one skilled in the art that other materials, including nonresilient materials, may be suitably used in the formation of the limit stops, such as metals, woods, springs, air cushions, etc. The limit stops 198 are positioned upon the press yoke 182 so as to bear against the undersides of the press arms 108 and 110, to impede the press arms 108 and 110 from rotating past a selected position.

Figure 4:
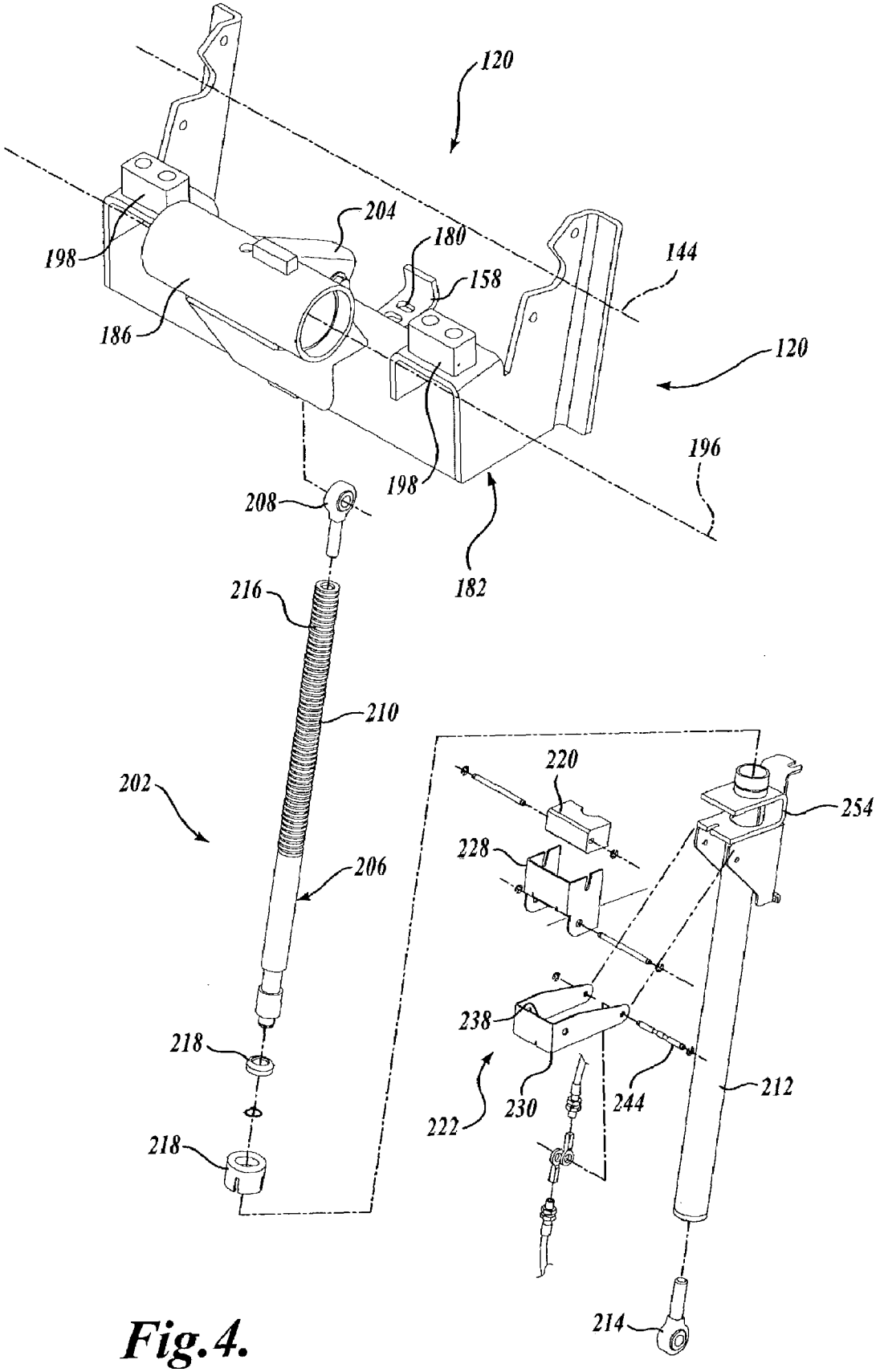
FIG. 4 is an exploded perspective view of the rest position assembly and a rest position adjustment assembly partially depicted in FIG. 1.
Figure 5:
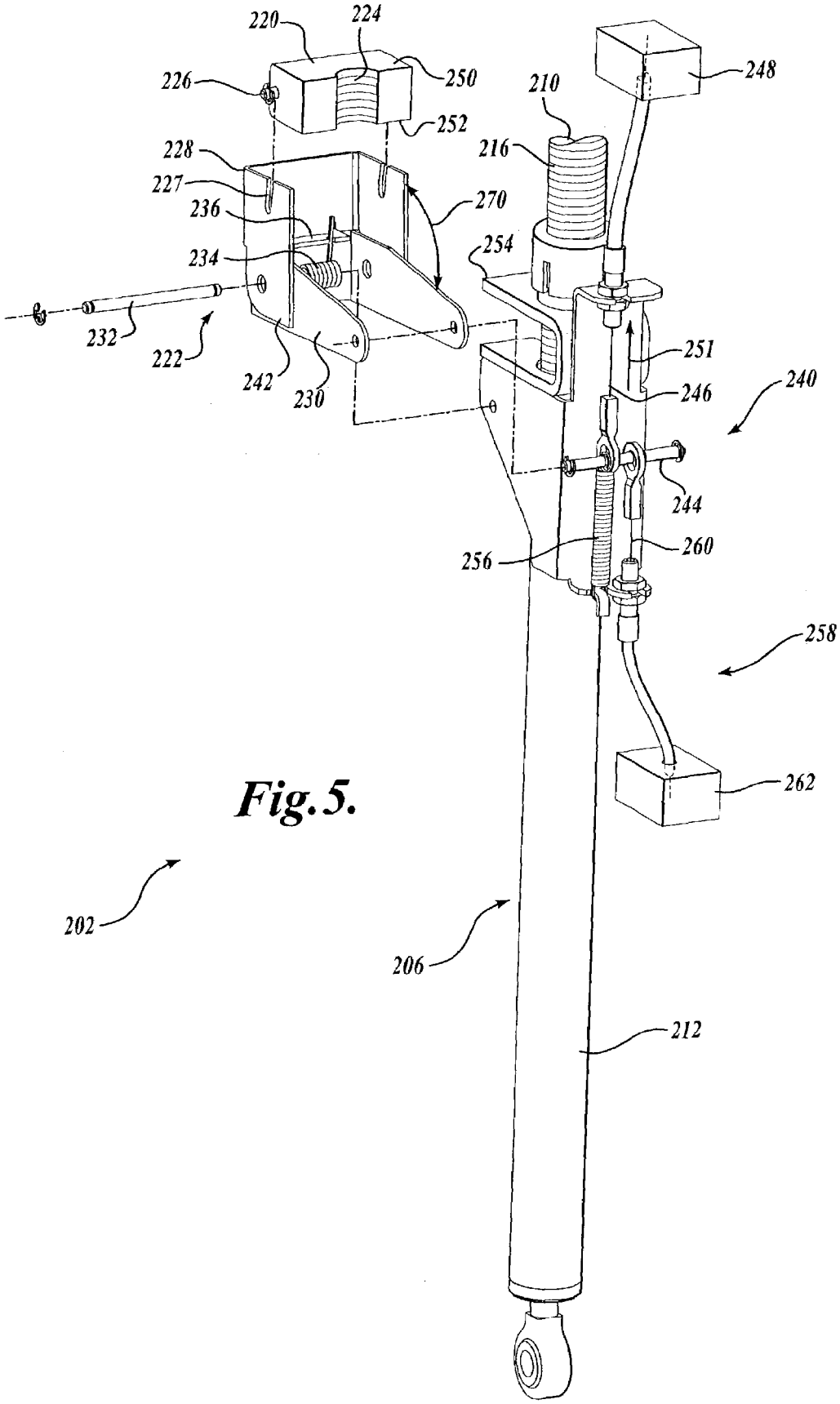
FIG. 5 is an exploded perspective view of the rest position adjustment assembly depicted in FIG. 4.

Referring to FIGS. 4 and 5, this portion of the detailed description will now describe the rest position adjustment mechanism 202. In this embodiment, a telescoping strut is used to control the angular orientation of the rest position assembly. The adjustment mechanism 202 is coupled between the frame 102 (see FIG. 1) and a clevis 204 carried by the press yoke 182 of the rest position assembly 120. The rest position adjustment mechanism 202 includes a strut 206 that is adjustable in length. Adjusting the length of the strut 206 causes the rest position assembly 120 to rotate about its rest position assembly pivot axis 196 to adjust the starting height of the handles 112 and 114 of the press arms 108 and 10 when the press arms are in the rest position.

The strut 206 includes a first end connector 208, a threaded rod 210, a receiver tube 212, and a second end connector 214. The first end connector 208 is attached to a distal (upper) end of the rod 210, and is used to couple the rod 210 to the clevis 204. The rod 210 includes an engagement portion 216 including a plurality of engagement members. In the illustrated embodiment, the engagement members are a plurality of protrusions, and more specifically ACME threads. However, those skilled in the art will appreciate that the engagement portion 216 may be formed in alternate manners, e.g., using teeth, dimples, roughened surfaces, holes, pins, recesses, or other such structures that allow a first part to grip or couple to a second part.

The rod 210 is slidably receivable within the receiver tube 212 with the aid of a pair of bushings 218. The second end connector 214 is attached to a distal end of the receiver tube 212, and is used to couple the bottom of the receiver tube 212 to the frame.

Referring to FIG. 5, the rest position adjustment mechanism 202 includes a locking member 220 pinned to a locking member positioning system 222. The locking member 220 may include an engagement portion 224 having a plurality of engagement members adapted to cooperatively engage the engagement portion 216 of the rod 210, e.g., a halfnut is the locking member shown in FIG. 5. In the illustrated embodiment, the engagement portion 224 includes a plurality of protrusions comprising ACME threads. However, those skilled in the art will appreciate that the engagement portion 224 may be formed in alternate manners, such as to include a textured surface which may include teeth, dimples, a roughened surface, holes, a pin or pins, recesses, or other such structures that allow a first part to grip or couple to a second part.

The locking member 220 is pivotally coupled to the locking member positioning system 222 by pins 226 protruding outwardly from the ends of the locking member 220 to engage within slots 227 formed in a locking member bracket 228. The bracket 228 is pivotally coupled to a release bracket 230 by a cross pin 232. The cross pin 232 is also used to couple the locking member positioning system 222 to the strut 206. A biasing device 234, such as a torsion spring, may be engaged over the pin 232 to rotationally bias the locking member bracket 228 away from the release bracket 230. The locking member bracket 228 and the release bracket 230 are disposed relative to each other at a selected separation angle 270. The locking member bracket 228 is impeded from rotating past the separation angle 270, depicted in FIG. 5, by engagement of a lip portion 236 of the locking member bracket 228 with a top edge 238 (see FIG. 4) of the release bracket 230. However, the release bracket 230 is free to rotate toward the locking member bracket 228, i.e., as to decrease the separation angle 270, when the biasing force exerted by the biasing device 234 is overcome.

Referring back to FIG. 5, a distal end 242 of the release bracket 230 is pivotally coupled to a control assembly 240 by a cross pin 244. The control assembly 240 includes a first cable 246, the distal end of which is anchored to an actuation mechanism 248. The actuation mechanism 248 may be any mechanism operable to impart movement to the first cable 246, such as a handle, solenoid, etc. In the illustrated embodiment and in reference to FIG. 1, a release lever 266 is utilized as the actuation mechanism 248. The release lever 266 is rotatingly mounted upon one of the press arms 108 or 110 such that a user can operate the release lever 266 while gripping its respective handle. The first cable 246 is coupled to the release lever 266, such that when the release lever 266 is actuated by the user, the cable 246 moves in the direction of arrow 251.

When the first cable 246 moves in the direction of arrow 251, the release bracket 230 is rotated toward the locking member bracket 228 so as to decrease the separation angle 270. Due to the biasing device 234, a rotational force is applied to the locking member bracket 228, which applies a disengagement force upon the locking member 220. If the strut 206 is in a substantially nonloaded state, the disengagement force will be sufficient to force the locking member 220 to disengage from the rod 210. However, if the strut 206 is in a loaded state, the disengagement force will be insufficient to overcome the friction forces present between the locking member 220 and the strut 206. More specifically, when the strut 206 is in a loaded condition, either the upper surface 250 or the lower surface 252 (depending on whether the strut is in tension or compression) of the locking member 220 and a locking member receiving bracket 254, coupled to the receiver tube 212, will be loaded against each other, thereby creating friction forces impeding the movement of the locking member 220 away from the strut 206. This system has the benefit of preventing disengagement of the strut while under load, thereby protecting both the user and the machine.

Coupled to the actuation system 248 is a seat release system 258. The seat release system 258 includes an actuation cable 260 and a well-known seat adjustment mechanism 262. The seat adjustment mechanism 262 may be actuated by the actuation cable 260 between a locked and unlocked state. When the seat adjustment mechanism 262 is in a locked state, the seat 106 is held in a fixed location. When the seat adjustment mechanism 262 is in an unlocked state, the seat is released and may be moved to another location.

In the illustrated embodiment, when the actuation system 248 is actuated, cable 246 is placed in tension, moving pin 244 in the direction of arrow 251, thereby actuating the release bracket 230 as discussed above. Inasmuch as cable 260 is also coupled to the pin 244, cable 260 is also placed in tension and thereby moved in the direction of arrow 251. Movement of cable 260 in the direction of arrow 251 allows a user to thereby move the location of the seat. Although the seat 106 is shown in different longitudinal positions in FIGS. 8 and 9, it should be apparent to those skilled in the art that the seat 106 may be adjusted in any number of ways, such as by changing the inclination of the back rest 264 of the seat 106 (see FIG. 9).

Figure 6:
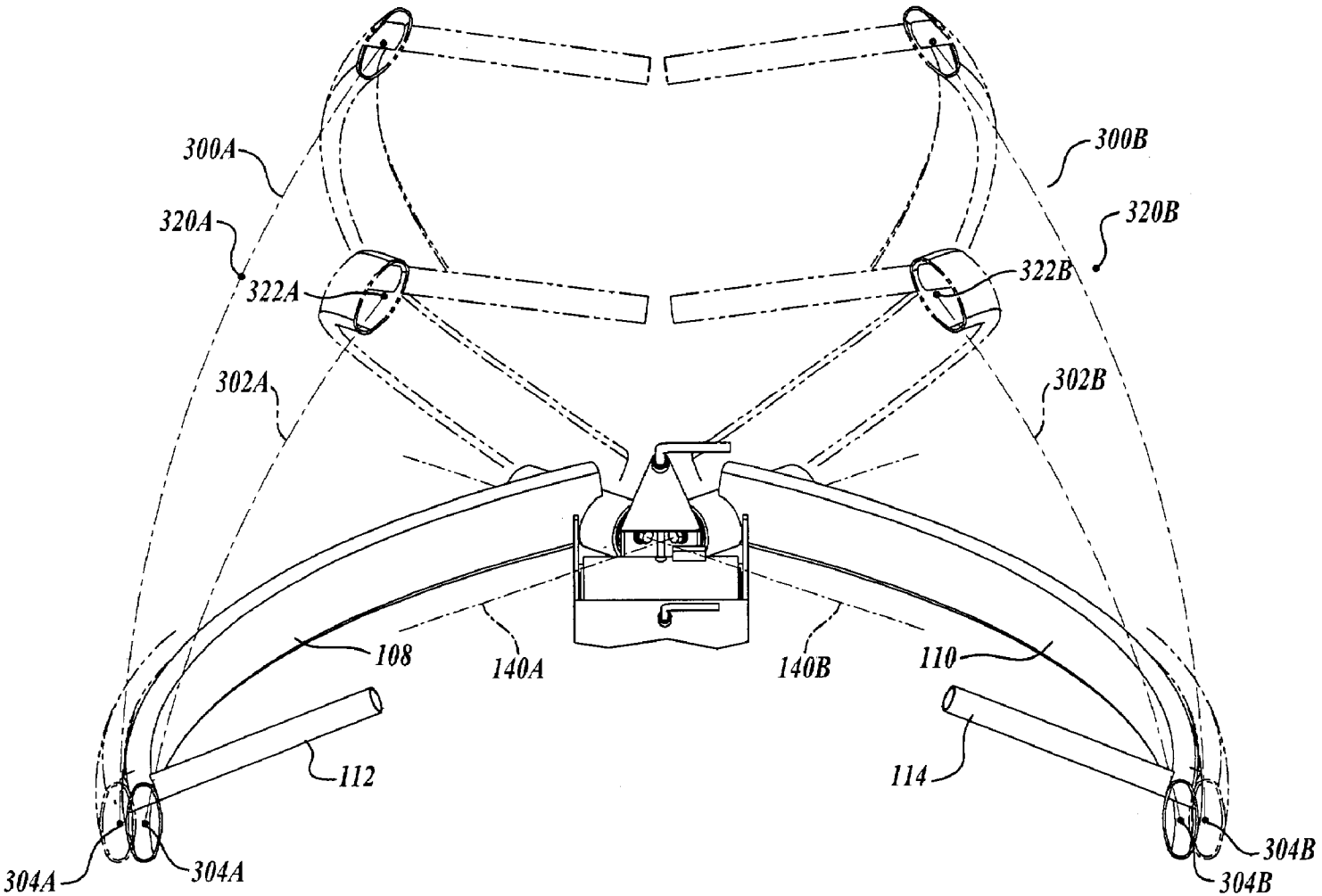
FIG. 6 is a diagrammatic front view of paths taken by two different pairs of press arms as they move from a rest position to an extended position.

Referring now to FIG. 6, the effect of the rotation of the support assembly 118 upon the path of the handles 112 and 114 will now be explained. During use, the rotation of the press arms results in the handles following arcuate paths in space. Since the angle 142 between the first press arm pivot axis 140A and the second press arm pivot axis 140B is less than 180 degrees, the combined paths of the press arms result in a shape that is similar to the outline of an orange peel segment, i.e., two arcs touching end to end, though formed in separate planes. During use, the user takes advantage of only a portion of these arcs. Rotation of the support assembly 118 relative to the frame 102 controls which portion is used.

In FIG. 6, when the support assembly 118 is at a first inclination, the press arms 108, 110 each scribe a first predetermined path 300A and 300B, respectively, when they are rotated about their respective pivot axes 140A, 140B. Also shown in FIG. 6 in phantom lines is the path taken by the arms when the support assembly 118 is rotated downward to a second inclination and the rest position is kept the same as that used for the first inclination. As shown, the resulting paths are the upper regions of the total arcuate paths available. In selecting which portion of the arcuate paths will be utilized, the user is also deciding how much lateral movement they want to experience during their workout.

Thus, by altering the inclination of the support assembly 118 from the first inclination orientation to the second inclination orientation, a user can adjust the path that the press arms 108 and 10 will take when rotated, and thereby adjust the exercise to the specific needs of the user.

Figure 7:
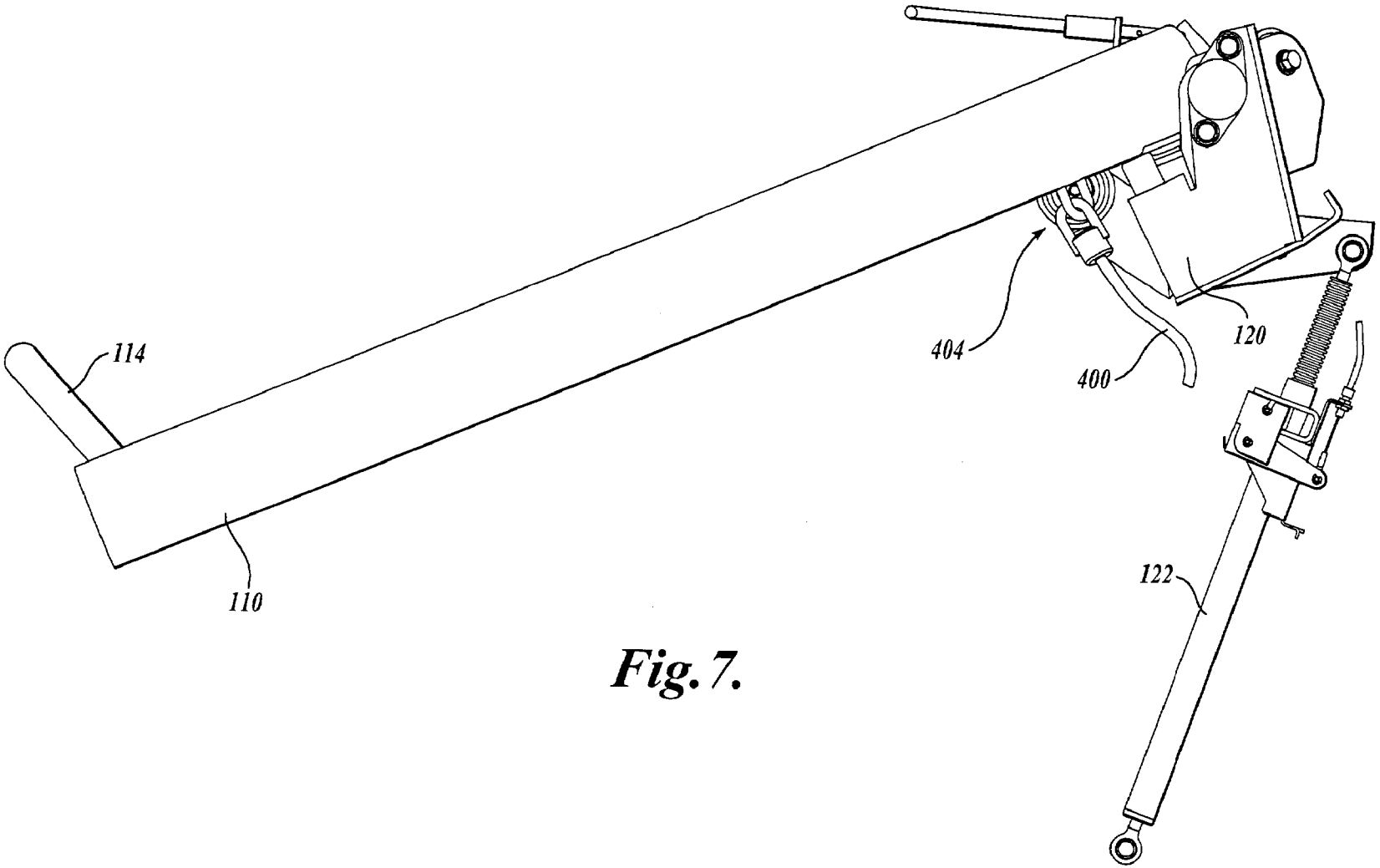
FIG. 7 is a side elevation view of the press assembly shown in FIG. 1 and the rest position assembly and rest position adjustment assembly depicted in FIG. 4.
Figure 8:
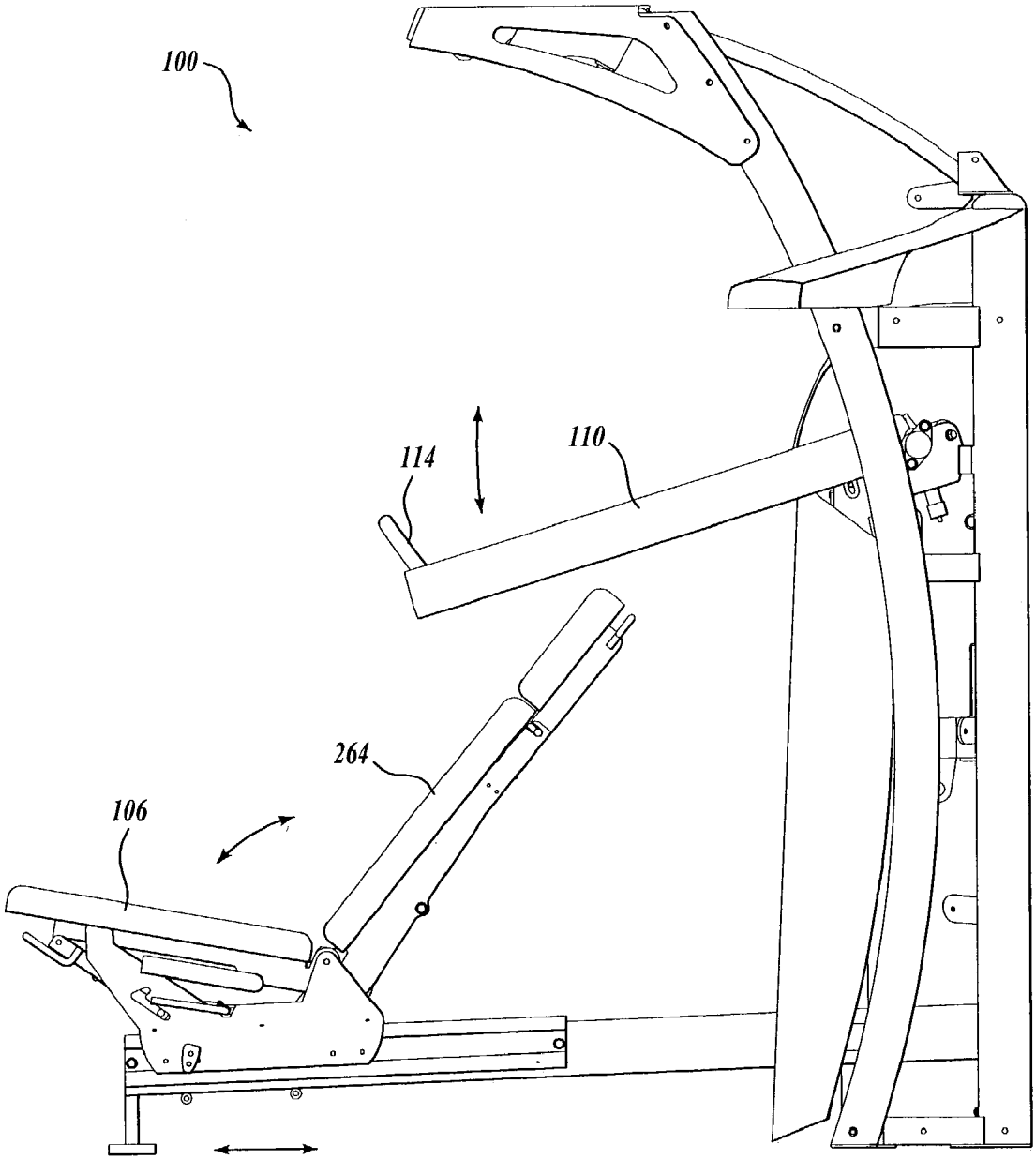
FIG. 8 is a side view of the exercise apparatus depicted in FIG. 6, the press arms being in a first rest position where the handles are suspended at the first elevation above the seat.
Figure 9:
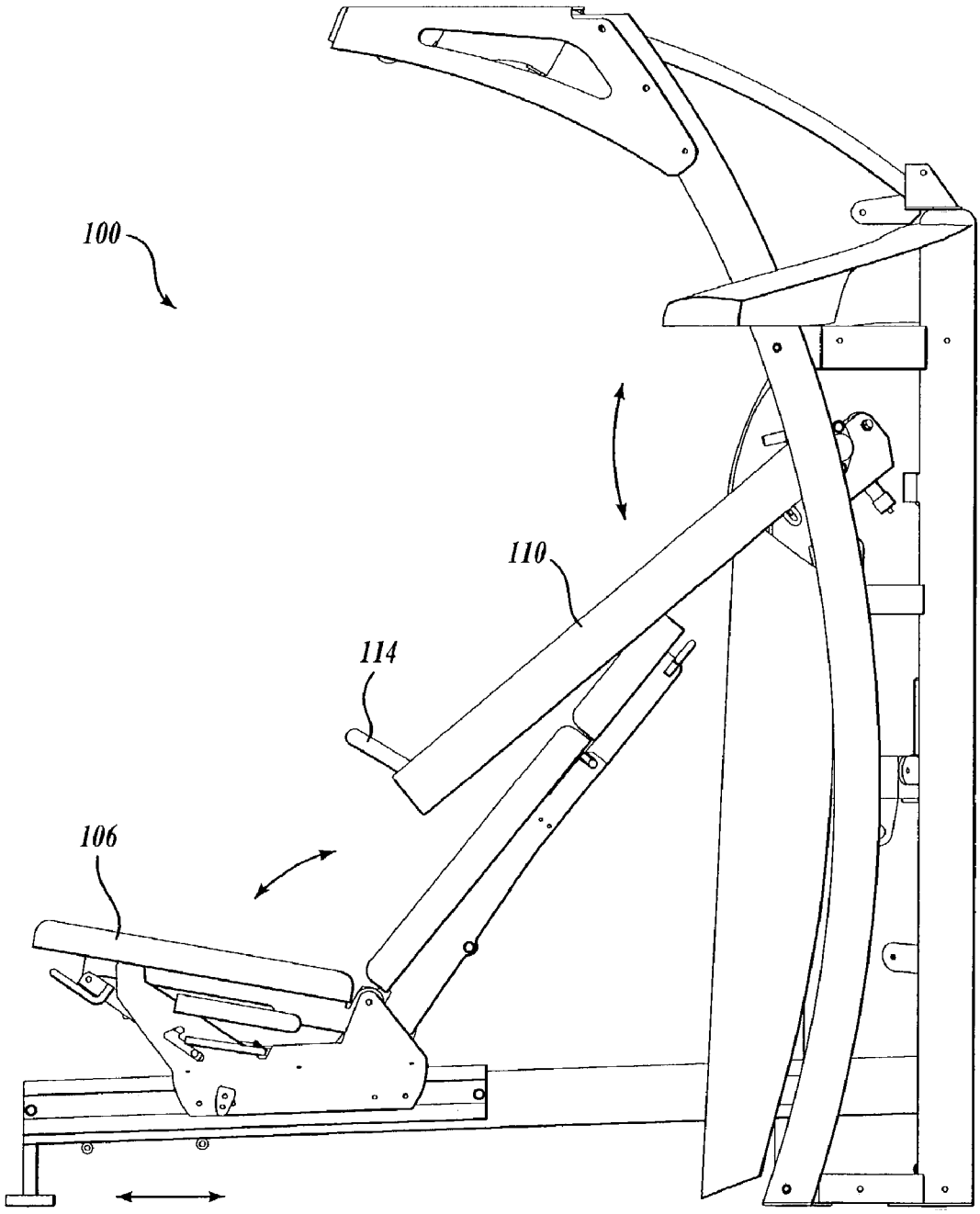
FIG. 9 is a side view of the exercise apparatus in which the press arms are in a second rest position, the handles being suspended at the second elevation above the seat.

Referring now to FIGS. 7–9, the rest position assembly 120 controls the starting height of the press arms 108 and 110 when in their respective rest positions by controlling the point at which the press arms 108 and 110 are engaged by the limit stops 198. As stated above, the limit stops 198, through engagement of the press arms 108 and 110, prevent further downward rotation of the press arms 108 and 110. By rotating the rest position assembly 120, the selected angle relative to the frame 102 at which the limit stops 198 engage the press arms 108 and 110 can adjusted, thereby adjusting the height at which the handles 112 and 114 of the press arms 108 and 110 are suspended above the floor when in their respective rest positions.

As should be apparent to those skilled in the art, although a first and a second inclination orientation are described in reference to the rest position assembly 120 of the illustrated embodiment, the rest position assembly 120 may be configured into any number of inclination orientations to provide any number of starting heights when the press arms 108 and 110 are in their respective rest positions. As should also be apparent to those skilled in the art, although a first and a second predetermined path are described in reference to the illustrated embodiment, the exercise apparatus may be configured into any number of predetermined paths.

During use, a person sits on seat 106 and activates the control assembly 240 to position the user a comfortable distance from the handles. Simultaneously, the person rotates the rest position assembly and thereby positions the handles at a comfortable height. Should the user desire a different amount of lateral movement, the user can adjust the support assembly by repositioning the locking pin 156 in a different aperture 180. The user can then move one or both arms to perform the desired workout. Resistance is provided in each arm by a cable 400 that attaches to the resistance source 116. In FIG. 7, the cable 400 is connected to the lower surface of arm 110 by a shackle 404. It is helpful to position this connection at a location in line with the rest position assembly pivot axis 196. Doing so allows the rest position to be adjusted without affecting the required length of the cable. A similar arrangement is provided for arm 108.

While the preferred embodiment of the invention has been illustrated and described, it will be appreciated that various changes can be made therein without departing from the spirit and scope of the invention. For example, the handles made be connected to the press arms in a manner that allows the handles to assume different positions and/or different orientations along their respective press arms. By way of further example, in an alternative embodiment, the press arms extend and retract during use in order scribe linear paths as opposed to arcuate segments.

The invention claimed is:

1. An exercise apparatus for performing press exercises comprising:

a frame;

a first press arm having proximal and distal ends, the proximal end being pivotally coupled to the frame about a single first axis;

a second press arm having proximal and distal ends, the proximal end being pivotally coupled to the frame about a single second axis; and a rest position assembly that provides a limit on the travel experienced by at least one of the first and second arms, the rest position assembly being pivotally connected to the frame via an adjustment mechanism;

wherein the adjustment mechanism comprises a telescoping strut coupled between the frame and the rest position assembly, whereby adjusting the strut length causes the rest position assembly to rotate about a fourth axis, thereby adjusting the location of the stops and the corresponding rest position of the arms;

wherein the first and second axes are positioned relative to one another so that during use, rotation of the arms about their respective first and second axes results in the distal ends scribing opposed, outwardly arcuate paths relative to one another;

whereby the first and second arms are connected to the frame in a manner that allows this path to coincide with the natural inward motion of a user's arms in going from a retracted position to an extended position.

2. The apparatus according to claim 1, wherein the first and second axes are oriented relative to one another by an angle in the range of about 80 degrees to about 100 degrees.

3. The apparatus according to claim 1, wherein the first and second axes are fixedly oriented relative to one another by an angle of about 90 degrees.

4. The apparatus according to claim 1, wherein the first and second arms are separately operable.

5. The apparatus according to claim 1, wherein the first and second arms are curved tubular struts that extend from first and second bearing tubes, respectively.

6. The apparatus according to claim 1, further comprising a support assembly adjustably coupled to the frame about a laterally oriented third axis; wherein the first and second pivot axes are coupled to the support assembly and are located an equal, though opposite, angular distance from the third axis; wherein adjusting the position of the support assembly relative to the frame causes the resulting opposed, outwardly arcuate paths to be repositioned relative to the frame as well.

7. The apparatus according to claim 6, wherein the support assembly includes a weldment having mounting brackets, the first and second arms each including a bearing tube that connects to a bracket.

8. The apparatus according to claim 7, wherein the frame includes a series of apertures and the support assembly includes a locking pin insertable into one of the apertures to hold the weldment at a given orientation.

9. The apparatus according to claim 1, wherein the press arms rotate in an up and down manner and wherein the rest position assembly includes stops that provide lower limits on the travel experienced by the press arms; the lower limit positions of the press arms being referred to as their rest positions.

10. The apparatus according to claim 1, wherein the telescoping strut includes an exposed end region and a distal end, the exposed end region being connected to the rest position assembly; whereby adjusting the strut length causes the rest position assembly to rotate about a fourth axis, thereby adjusting the location of the stops and the corresponding rest position of the arms; and the adjustment mechanism further comprising:

a receiver tube having a proximal end and a distal end connected to the frame; the strut being adjustably positioned within the receiver tube through its proximal end;

a locking member adapted to engage the strut exposed end region; and a locking member positioning system that selectively releases the engagement of the locking member from the strut; wherein release is possible only when the strut is not experiencing a load; when the strut is experiencing a load, the locking member is forced to continue engagement with the strut.

11. The apparatus of claim 1, wherein the adjustment mechanism includes a releasable locking member adapted to engage the strut and hold it at a select position.

12. The apparatus according to claim 11, wherein the strut and locking member are threaded members.

13. The apparatus according to claim 11, further comprising a release lever located on the machine that is connected to the releasable locking member to allow the strut to be remotely repositioned by the user.

14. The apparatus according to claim 13, wherein the release lever is connected to the locking member via a cable.

15. The apparatus according to claim 13, wherein the frame includes a seat and the release lever is located on at least one of the first and second press arms; during use, the release lever allowing a user to sit on the seat while repositioning the rest position assembly in order to comfortably reposition the rest position of the press arms.

16. The apparatus according to claim 15, wherein the seat is slidably attached to the frame, the seat having locked and unlocked positions; in the locked positions, the seat does not move relative to the frame; in the unlocked positions, the seat is slidable relative to the frame.

17. The apparatus according to claim 16, wherein operation of the release lever further controls engagement of the seat; during use, actuation of the release lever allows a user to simultaneously adjust the seat position while repositioning the rest position assembly.

18. The apparatus according to claim 1, further comprising a support assembly adjustably coupled to the rest position assembly about a laterally oriented third axis; wherein the first and second pivot axes are coupled to the support assembly and are located equal, though opposite, angular distances from the third axis; wherein adjusting the position of the support assembly relative to the rest position assembly causes the resulting opposed, outwardly arcuate paths to be repositioned relative to the rest position assembly as well.

19. The apparatus according to claim 18, wherein the rest position assembly includes a press yoke pivotally connected to the frame about the fourth axis, the support assembly being rotatably connected to the press yoke about its third axis, the third and fourth axes being substantially parallel to one another; wherein the rest position assembly includes first and second stops to limit the downward motion of the first and second press arms, respectively.

20. An exercise apparatus comprising:

a frame with a support point;

a load-bearing assembly connected to the frame; and an adjustment mechanism for altering the orientation of the load-bearing assembly relative to the support point, the adjustment mechanism including:

a telescoping strut including an exposed end region and a distal end, the exposed end region being connected to the load-bearing assembly;

a receiver tube having a proximal end and a distal end connected to the support point, the strut being adjustably positioned within the receiver tube through its proximal end;

a locking member adapted to engage the strut exposed end region;

a biasing device coupled to the locking member such that the locking member is biased to normally engage the strut; and a locking member positioning system that selectively releases the engagement of the locking member from the strut;

wherein release is possible when the strut is not experiencing a load; when the strut is experiencing a load, the locking member continues engagement with the strut.

21. The apparatus according to claim 20, wherein the locking member and strut are threaded members.

22. The apparatus according to claim 20, wherein the locking member positioning system includes a receiving bracket coupled to the strut proximal end and a release bracket pivotally connected to the receiving bracket and to the locking member; wherein, as assembled, rotation of the receiving bracket away from the strut urges corresponding rotation of the locking member.

23. The apparatus according to claim 22, wherein a cable is used to rotate the receiving bracket away from the strut.

24. The apparatus according to claim 22, wherein the locking member positioning system further includes a locking member bracket rotatably interconnected between the release bracket and the locking member, and further includes a biasing member to urge the locking member bracket and release bracket to a first position; wherein, when the strut is not experiencing a load, rotation of the release bracket causes like rotation of the locking member bracket and locking member due to the urging of the biasing member; and wherein, when the strut is experiencing a load, the engaging forces between the locking member and the strut are greater than the urging force of the biasing member, thus, rotation of the release bracket causes the release bracket to rotate toward the locking member bracket against the biasing member force but does not result in rotating the locking member bracket and locking member to disengage the strut.

25. An exercise apparatus for performing press exercises comprising:

a frame;

a first press arm pivotally coupled to the frame about a first axis;

a second press arm pivotally coupled to the frame about a second axis, the first and second axes being oriented relative to one another by an angle in the range of about 80 degrees to about 100 degrees;

means for adjustably coupling the press arms to the frame such that an inclination of the first and second axes relative to the frame may be adjusted between a first inclination and a second inclination such that a distal end of the press arms will follow a first predetermined path when rotated a predetermined angle about the press arm's respective axis when that axis is at the first inclination and such that the distal end will follow a second predetermined path when the press arms are rotated the predetermined angle about the press arm's respective axis when that axis is at the second inclination; and means for adjusting the pivot axis of the press arms between the first and second inclinations.

26. The exercise apparatus of claim 25, further including a seat coupled to the frame and means for adjusting the seat between a first position and a second position.

27. The exercise apparatus of claim 26, wherein the press arm includes a rest position; further including means for adjusting the rest position; and further including means for simultaneously actuating the seat and the means for adjusting the rest position of the press arm.

28. An exercise apparatus for performing press exercises comprising:

a frame;

a first press arm having proximal and distal ends, the proximal end being pivotally coupled to the frame about a single first axis;

a second press arm having proximal and distal ends, the proximal end being pivotally coupled to the frame about a single second axis;

a rest position assembly that provides a limit on the travel experienced by at least one of the first and second arms, the rest position assembly includes a press yoke pivotally connected to the frame about a fourth axis; and a support assembly being rotatably connected to the press yoke about a third axis;

wherein the first and second axes are positioned relative to one another so that during use, rotation of the arms about their respective first and second axes results in the distal ends scribing opposed, outwardly arcuate paths relative to one another;

whereby the first and second arms are connected to the frame in a manner that allows this path to coincide with the natural inward motion of a user's arms in going from a retracted position to an extended position.

29. The apparatus according to claim 28, wherein the first and second axes are oriented relative to one another by an angle in the range of about 80 degrees to about 100 degrees.

30. The apparatus according to claim 28, wherein the first and second axes are fixedly oriented relative to one another by an angle of about 90 degrees.

31. The apparatus according to claim 28, wherein the first and second arms are separately operable.

32. The apparatus according to claim 28, wherein the first and second arms are curved tubular struts that extend from first and second bearing tubes, respectively.

33. The apparatus according to claim 28, wherein the first and second pivot axes are coupled to the support assembly and are located an equal, though opposite, angular distance from the third axis; wherein adjusting the position of the support assembly relative to the frame causes the resulting opposed, outwardly arcuate paths to be repositioned relative to the frame as well.

34. The apparatus according to claim 28, wherein the press arms rotate in an up and down manner and wherein the rest position assembly includes stops that provide lower limits on the travel experienced by the press arms; the lower limit positions of the press arms being referred to as their rest positions.

35. The apparatus according to claim 28, wherein the rest position assembly is pivotally connected to the frame via a rest position adjustment mechanism comprising:

a telescoping strut including an exposed end region and a distal end, the exposed end region being connected to the rest position assembly; whereby adjusting the strut length causes the rest position assembly to rotate about its fourth axis, thereby adjusting the location of the stops and the corresponding rest position of the arms;

a receiver tube having a proximal end and a distal end connected to the frame; the strut being adjustably positioned within the receiver tube through its proximal end;

a locking member adapted to engage the strut exposed end region; and a locking member positioning system that selectively releases the engagement of the locking member from the strut; wherein release is possible only when the strut is not experiencing a load; when the strut is experiencing a load, the locking member is forced to continue engagement with the strut.

36. The apparatus according to claim 28, wherein the rest position assembly is pivotally connected to the frame via a rest position adjustment mechanism including a telescoping strut coupled between the frame and the rest position assembly, whereby adjusting the strut length causes the rest position assembly to rotate about its fourth axis, thereby adjusting the location of the stops and the corresponding rest position of the arms.

37. The apparatus according to claim 36, wherein the adjustment mechanism includes a releasable locking member adapted to engage the strut and hold it at a select position.

38. The apparatus according to claim 37, wherein the strut and locking member are threaded members.

39. The apparatus according to claim 37, further comprising a release lever located on the machine that is connected to the releasable locking member to allow the strut to be remotely repositioned by the user.

40. The apparatus according to claim 39, wherein the release lever is connected to the locking member via a cable.

41. The apparatus according to claim 39, wherein the frame includes a seat and the release lever is located on at least one of the first and second press arms; during use, the release lever allowing a user to sit on the seat while repositioning the rest position assembly in order to comfortably reposition the rest position of the press arms.

42. The apparatus according to claim 41, wherein the seat is slidably attached to the frame, the seat having locked and unlocked positions; in the locked positions, the seat does not move relative to the frame; in the unlocked positions, the seat is slidable relative to the frame.

43. The apparatus according to claim 42, wherein operation of the release lever further controls engagement of the seat; during use, actuation of the release lever allows a user to simultaneously adjust the seat position while repositioning the rest position assembly.

44. The apparatus according to claim 28, wherein the first and second pivot axes are coupled to the support assembly and are located equal, though opposite, angular distances from the third axis; wherein adjusting the position of the support assembly relative to the rest position assembly causes the resulting opposed, outwardly arcuate paths to be repositioned relative to the rest position assembly as well.

45. The apparatus according to claim 28, wherein the third and fourth axes are substantially parallel to one another; wherein the rest position assembly includes first and second stops to limit the downward motion of the first and second press arms, respectively.

46. An exercise apparatus comprising:

a frame with a support point;

a load-bearing assembly connected to the frame; and an adjustment mechanism for altering the orientation of the load-bearing assembly relative to the support point, the adjustment mechanism including:

a telescoping strut including an exposed end region and a distal end, the exposed end region being connected to the load-bearing assembly;

a receiver tube having a proximal end and a distal end connected to the support point; the strut being adjustably positioned within the receiver tube through its proximal end;

a locking member adapted to engage the strut exposed end region; and a locking member positioning system that selectively releases the engagement of the locking member from the strut, the locking member positioning system comprising a receiving bracket coupled to the strut proximal end and a release bracket pivotally connected to the receiving bracket and to the locking member;

wherein release is possible when the strut is not experiencing a load; when the strut is experiencing a load, the locking member continues engagement with the strut;

wherein, as assembled, rotation of the receiving bracket away from the strut urges corresponding rotation of the locking member.

47. The apparatus according to claim 46, further comprising a biasing device coupled to the locking member such that the locking member is biased to normally engage the strut.

48. The apparatus according to claim 46, wherein the locking member and strut are threaded members.

49. The apparatus according to claim 46, wherein a cable is used to rotate the receiving bracket away from the strut.

50. The apparatus according to claim 46, wherein the locking member positioning system further includes a locking member bracket rotatably interconnected between the release bracket and the locking member, and further includes a biasing member to urge the locking member bracket and release bracket to a first position; wherein, when the strut is not experiencing a load, rotation of the release bracket causes like rotation of the locking member bracket and locking member due to the urging of the biasing member; and wherein, when the strut is experiencing a load, the engaging forces between the locking member and the strut are greater than the urging force of the biasing member, thus, rotation of the release bracket causes the release bracket to rotate toward the locking member bracket against the biasing member force but does not result in rotating the locking member bracket and locking member to disengage the strut.

51. An exercise apparatus for performing press exercises comprising:

a frame;

a press arm pivotally coupled to the frame about a first axis;

a seat coupled to the frame;

means for adjustably coupling the press arm to the frame such that an inclination of the first axis relative to the frame may be adjusted between a first inclination and a second inclination such that a distal end of the press arm will follow a first predetermined path when rotated a predetermined angle about the first axis when the first axis is at the first inclination and such that the distal end will follow a second predetermined path when the press arm is rotated the predetermined angle about the first axis when the first axis is at the second inclination; and means for simultaneously adjusting the seat and adjusting the rest position of the press arm.

52. The exercise apparatus of claim 51, further including a second press arm pivotally coupled to the frame about a second axis, the first and second axes being oriented relative to one another by an angle in the range of about 80 degrees to about 100 degrees.

* * * * *